US005826596A

United States Patent [19]

Brenn-Albertoni

[11] Patent Number: 5,826,596

[45] Date of Patent: Oct. 27, 1998

[54] AERATED FABRIC TAPE FOR THE PRODUCTION OF SELF-ADHERING HAIR-CURLERS AND HAIR-CURLERS PRODUCED FROM SUCH TAPE

[76] Inventor: Gemma Brenn-Albertoni, Via C. Ghiringhelli 55, Bellinzona, CH-6500, Switzerland

[21] Appl. No.: 781,208

[22] Filed: Jan. 10, 1997

[30] Foreign Application Priority Data

Jan. 13, 1996 [CH] Switzerland ..... 00101/96

[51] Int. Cl.[6] ..... A45D 2/14

[52] U.S. Cl. ..... 132/262

[58] Field of Search ..... 132/222, 226, 132/250, 262, 267

[56] References Cited

U.S. PATENT DOCUMENTS

| | | | |
|---|---|---|---|
| D. 200,284 | 2/1965 | Natsukawa | 132/226 |
| 3,123,080 | 3/1964 | Brenn-Albertoni | 132/262 |
| 3,267,942 | 8/1966 | De Mestral | 132/40 |
| 3,422,823 | 1/1969 | Marforio | 132/40 |
| 3,539,436 | 11/1970 | Hamano | 132/262 |
| 3,540,457 | 11/1970 | Solomon | 132/40 |
| 3,543,772 | 12/1970 | Kanai | 132/262 |
| 3,556,114 | 1/1971 | Simon | 132/262 |

FOREIGN PATENT DOCUMENTS

| | | | |
|---|---|---|---|
| 0 198 182 | 10/1986 | European Pat. Off. . | |
| 0 568 919 | 11/1993 | European Pat. Off. . | |
| 1229686 | 12/1966 | Germany | 132/226 |
| 957645 | 5/1964 | United Kingdom . | |

*Primary Examiner*—Todd E. Manahan
*Attorney, Agent, or Firm*—Millen, White, Zelano & Branigan, P.C.

[57] ABSTRACT

An aerated fabric tape is provided for the production of self-adhering, flexible hair-curlers, of a type comprising primary and secondary groups of warp threads. The warp threads are joined to one another by weft threads which connect the groups of warp threads. Each of the primary groups of warp threads is separated from the next group by a distance of from 2 to 10 mm, the weft threads being configured so as to allow the groups of warp threads to approach each other or to separate when the tape is subjected to transverse flexing.

19 Claims, 1 Drawing Sheet

AERATED FABRIC TAPE FOR THE PRODUCTION OF SELF-ADHERING HAIR-CURLERS AND HAIR-CURLERS PRODUCED FROM SUCH TAPE

BACKGROUND OF THE INVENTION

The present invention relates to an aerated fabric tape for the production of flexible self-adhering hair-curlers and, in particular, a tape with intrinsic partial flexibility which can be wound around a cylindrical support element, or which can fixed directly to a reinforcing element so that a hair-curler can be obtained without any other support element.

FIELD OF THE INVENTION

Various types of fabric tape are used at present for the production of flexible hair-curlers which have a filament-like means of retaining and setting the hair. These known types of tape are not intrinsically flexible. It is possible to obtain flexible hair-curlers with such tapes only if the tape is applied in a particular way to a cylindrical support, e.g. in a helical configuration. An example of a hair-curler using this technique of the prior art is illustrated in a previous patent in the name of the Applicant. However, the curler described in the said patent was not produced on an industrial scale because of the high costs and technical difficulties of production.

Other reinforced aerated fabric tapes are known from another patent application in the name of the Applicant for the direct production of hair-curlers without further tubular support. A portion of the reinforced tape is folded and fixed along a pair of opposite edges to form the curler. Various drawbacks have arisen in the application of the reinforcing element by gluing, by welding or by means of other known techniques with the result that the tape and the reinforcing element do not adhere to each other and tend to separate.

OBJECTS OF THE INVENTION

The aim of the present invention is to overcome the aforementioned drawbacks.

One object of the present invention within the scope of the said aim is to produce an aerated fabric tape from which self-adhering hair-curlers can be produced both simply and economically.

Another object of the present invention is to produce an aerated fabric tape from which self-adhering hair-curlers can be produced which have intrinsic flexibility and can be used in the longitudinal direction to produce flexible self-adhering hair-curlers.

Yet another object of the present invention is to produce an aerated fabric tape from which self-adhering hair-curlers can be produced which allow good aeration of the hair while maintaining a good degree of adhesion to the same hair.

A further object of the present invention is to produce an aerated fabric tape from which self-adhering hair-curlers can be produced which are light and substantially transparent.

SUMMARY OF THE INVENTION

These objects are achieved by the present invention which relates to an aerated fabric tape for the production of flexible self-adhering hair-curlers of a type comprising primary and secondary groups of warp threads carrying filament-like elements to hold and set the hair and by weft threads connecting the groups of warp threads, characterized by each group of primary warp threads being separated from the next group of warp threads by a length from 2 to 10 mm, and the weft threads between the primary groups of warp threads and the next secondary groups of warp threads being so structured and/or connected that there is mutual movement together or apart of the primary and secondary groups of warp threads when the tape is subjected to transverse flexing.

A single tape thus constructed could be used to fabricate hair-curlers of any size. The layout of the warp and weft threads confers substantial transparency on the tape, so as to allow different coloured support or reinforcing elements to be used to produce hair-curlers of different diameter. Different diameter hair-curlers are already identified by different colours.

Furthermore, in a preferred embodiment of the present invention, the warp threads and/or the groups of the warp threads have different colours each other, which adapt to different coloured support bodies. This allows the production of hair-curlers to be simplified and reduces the costs of production and storage.

A tape is obtained which is flexible mainly in the side areas and thus adapts itself to the shape assumed by the hair-curler when the latter is applied.

The thinning of the means of holding and setting the hair allows advantageously greater aeration through the tape and assists the freeing of the curler from the hair, especially long hair.

According to a preferred embodiment, the groups of secondary warp threads are laid in the center of the tape with the groups closely grouped, and the groups of primary warp threads are laid between the secondary groups and the edges of the tape.

The weft threads are very thin and are laid parallel, crossing or overlaid, or otherwise the weft consist of loops which move with respect to the warp groups and/or are interlocked and move with respect to each other.

The weft may be laid in other configurations e.g. zig-zag or with particular patterns such as that obtained with a crochet loom, provided that the primary groups of warp threads can come together or separate reciprocally when the tape is subjected to transverse flexing. The weft threads can be rendered flexible by using elastic material or a material which is made elastic by special treatment by heat, chemicals or other means.

According to an embodiment of the invention, the filament-like elements associated with the primary and/or secondary groups of warp threads are pairs of filament-like elements at least one of the two elements of which is curved or has a curved portion towards the free end. In the case where both elements of each pair are curved or have a curved outer portion, the curvature may be converging or diverging.

The filament-like elements which protrude from the second group of warp threads consist of a pairs of filament-like elements preferably straight and provided with a small bulge or a curved portion at their free end.

According to another embodiment of the invention, the filament-like elements to hold and set the hair gradually increase in length from the center to the edge of the tape.

The tape according to the invention may be reinforced stably for the direct production of hair-curlers without further tubular support. To anchor the plastic reinforcing stably, during weaving of the tape, small projections in the form of loops, curls, mushroom heads or similar shapes are raised on the part opposite that from which project the means of holding and setting the hair. The reinforcing material is preferably plastic, pre-coloured and applied in such a way as to give a geometric pattern.

According to a further embodiment, there are provided reinforcing elements consisting of small plates of plastic material incorporated into one or more lines of the weft during the weaving of the tape.

The invention further relates to a hair-curler obtained by using an aerated fabric tape as described above.

The present invention will be now described in greater detail in relation to some preferred embodiments which are presented only as examples and thus are not limiting; reference will be made to the attached drawings in which:

DESCRIPTION OF THE PREFERRED EMBODIMENTS

Figure 1:
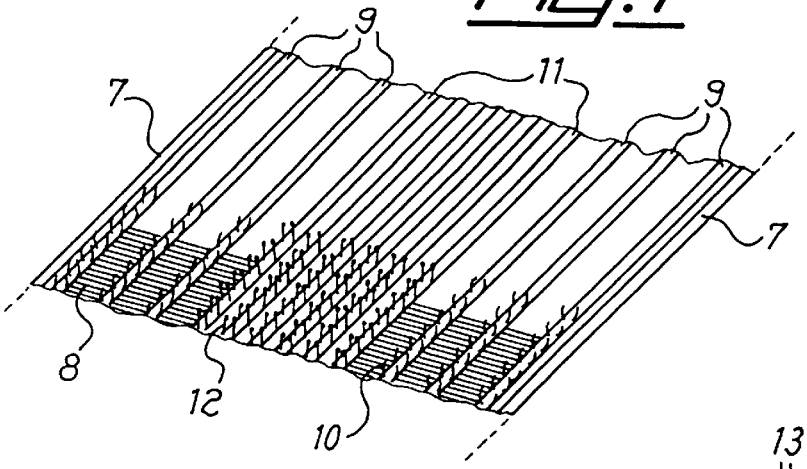
FIG. 1 is a schematic perspective view of a portion of aerated fabric tape according to the present invention.

FIG. 1 shows a portion of the aerated fabric tape comprising a weft 8 of very fine transparent thread, groups of warp threads 9 and 11 included within a pair of edges 7 of the tape.

The group of warp threads 11, laid longitudinally in the central part of the tape, have filament-like projections 12 having a small bulge or a portion curved into a hook on their free end. The group of warp threads 9, laid laterally to the group 11, have instead pairs of filamentlike elements 10 curved towards each other at their free end.

The group of warp threads 9 are separated by a length from 2 to 10 mm. The filament-like elements 12 serve as a means of combing and hold the lock of hair as required in professional use, ensuring optimum adhesion of the hair to the hair-curler even from the start of rolling.

The filament-like elements are closer together in the center and more widely separated towards the edges of the tape. One of the advantages of this layout is that the closer together filament-like elements in the center ensure optimum adhesion of the hair to the hair-curler even from the start of rolling.

Due to the structure of the thin and transparent weft threads 8 and to the spatial arrangement of the warp threads 9, the tape is flexible and therefore the hair-curler, once the tape has been applied to a flexible tubular support, it adapts to the shape of the head.

Figure 2:
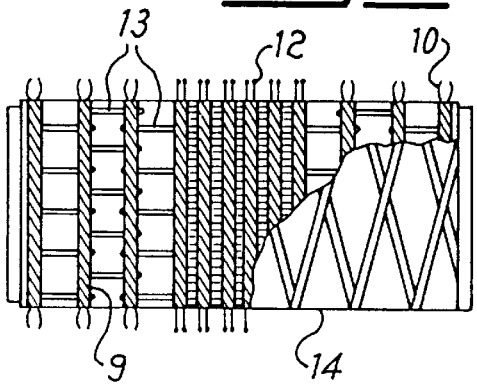
FIG. 2 is a hair-curler obtained from the aerated fabric tape according to the invention.

FIG. 2 shows a flexible tubular body 14 about which is wound a portion of the tape according to a possible embodiment. The groups of warp threads 9 are connected together by loops which run with respect to the same groups of warp threads, thus allowing the same groups of warp threads to approach or separate and conferring the required degree of flexibility to the edges of the tape.

Figure 6:
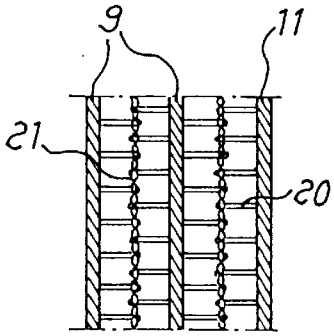
FIG. 6 is an enlargement of a detail of the aerated fabric tape according to the invention.

Alternatively, as shown in FIG. 6, the weft threads 8 can be used to form interlocking loops 20 which move along the chain 21 and connect the groups of warp threads 9 and 11.

Figure 3:
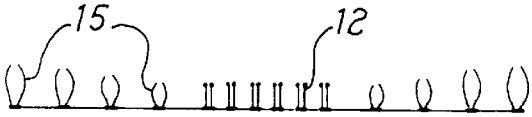
FIG. 3 is a cross section of the aerated fabric tape according to a possible embodiment of the invention.

FIG. 3 shows a form of embodiment of the tape in which the filament-like elements 15, curved at their free end, gradually increase in length as the edge 7 of the tape is reached. In this case, the filament-like elements 15 which hold and set the hair enable the hair-curler to fit more closely to the head thus improving the set characteristics.

Figure 4:
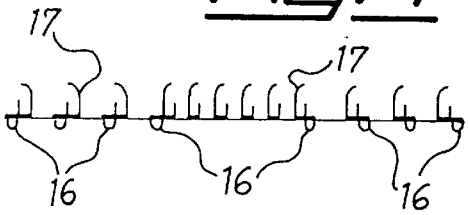
FIG. 4 is a cross section of the aerated fabric tape according to another possible embodiment of the invention.

FIG. 4 shows a section of tape in which under the groups of warp threads 9 and part of the groups of warp threads 11, there are loop-shaped filament-like anchor elements 16 which serve to fix a plastic material securely, for the purpose of reinforcing the tape to make it suitable for the direct production of the hair-curler without further tubular support.

Furthermore, the pairs of filament-like elements 17 which project from the groups of warp threads 9 and 11 to hold and set the hair consist of an element shaped like a pin and an element whose free end is curved.

Figure 5:
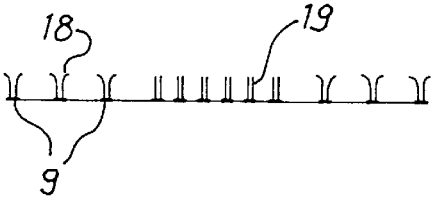
FIG. 5 is a cross section of the aerated fabric tape according to yet another possible embodiment of the invention.

FIG. 5 shows a further form of embodiment of the tape, in which the pairs of filament-like elements 18 which project from the groups of warp threads 9 diverge and those pairs of filament-like elements 19 which project from the groups of warp threads 11 are in the form of pins.

I claim:

1. An aerated fabric tape for the production of flexible self-adhering hair-curlers, comprising primary and secondary groups of warp threads (9 and 11) carrying filament-like elements (10, 12, 15, 17, 18, 19) to hold and set the hair, and weft threads (8) connecting the groups of warp threads, wherein each group of primary warp threads (9) are separated from the next group of warp threads (9, 11) by a distance of from 2 to 10 mm; and wherein the weft threads (8) extending between the primary groups or warp threads(9) and the adjacent secondary groups of warp threads (11) are connected for mutual movement toward or away from the primary (9) and secondary groups (11) of warp threads when the tape is subjected to transverse flexing.

2. A tape according to claim 1, wherein the groups of secondary warp threads (11) are laid in a center portion of the tape with the groups (11) closely grouped, and the groups of primary warp threads (9) being laid between the said secondary groups (11) and the edges (7) of the tape.

3. A tape according to claim 1, characterized by the said weft threads (8) being laid parallel, crossing or overlaid.

4. A tape according to claim 1 characterized by the said weft (8) being comprised of loops (13) which move with respect to the warp groups and being interlocked and moving with respect to each other.

5. A tape according to claim 1, characterized by the weft threads (8) being obtained by using elastic material or a material which is made elastic by special treatment using heat or chemicals.

6. A tape according to claim 1 characterized by the said filament-like elements (10, 15, 17, 18) projecting from the primary (9) and secondary groups (11) of warp threads being pairs of filament-like elements at least one of the two elements is curved or has a curved portion towards the free end.

7. A tape according to claim 1 characterized by the said filament-like elements (12, 19) projecting from the said secondary groups (11) of warp threads being pairs of straight filament-like elements.

8. A tape according to claims 7, characterized by the filament-like elements (12) having a small bulge or curved portion at their free end.

9. A tape according to claim 1 characterized by the said filament-like elements (10, 15, 17, 18, 19) to hold and set the hair gradually increasing in length from the center to the edge (7) of the tape.

10. A tape according to claim 1 characterized by the said warp threads and/or the said groups of the warp threads being of different colours each other.

11. A tape according to claim 1 characterized by comprising small plates of plastic material incorporated into one or more lines of the weft during the weaving of the tape.

12. A tape according to claim 1 characterized by comprising filament-like means (16) in the form of loops, curls, mushroom heads or similar shapes, which are projecting from the side opposite that from which project means for holding and setting the hair, to anchor a reinforcing material to strengthen the tape.

13. A tape according to claim 12, characterized by the. said reinforcing material being plastic, pre-coloured and applied in such a way as to give a geometric pattern.

14. A self-adhering flexible hair-curler, comprising:

a tubular support to which is affixed a portion of an aerated fabric tape wherein the tape comprises primary and secondary groups of warp threads (9 and 11) carrying filament-like elements (10, 12, 15, 17, 18, 19) to hold and set the hair, and weft threads (8) connecting the groups of warp threads, wherein each group of primary warp threads (9) are seperated from the next group of warp threads (9, 11) by a distance of from 2 to 10 mm;

wherein the weft threads (8) extending between the primary groups of warp threads (9) and the adjacent secondary groups of warp threads (11) are connected for mutual movement toward or away from the primary (9) and secondary groups (11) of warp threads when the tape is subjected to transverse flexing.

15. The hair curlier of claim 14 wherein the aerated fabric tape is folded back upon itself and fixed along opposite edges.

16. The hair curlier of claim 14 wherein small plates of plastic material are incorporated into at least one line of weft during weaving of the tape.

17. The hair curlier of claim 14 wherein the tape is reinforced tape.

18. A method for producing a self-adhering flexible hair curler comprising:

providing an aerated fabric tape having primary and secondary groups of warp threads (9 and 11) carrying filament-like elements (10, 12, 15, 17, 18, 19) to hold and set the hair, and weft threads (9) are seperated from the next group of warp threads (9, 11) by a distance of from 2 to 10 mm; and wherein the weft threads (8) extending between the primary groups of warp threads (9) and the adjacent secondary groups of warp threads (11) are connected for mutual movement toward or away from the primary (9) and secondary groups (11) of warp threads when the tape is subjected to transverse flexing; and folding back on itself a portion of the tape and joining together opposite edges thereof.

19. The method of claim 18 further comprising reinforcing the weft during weaving by inserting small plastic plates into lines of weft.

* * * * *